United States Patent [19]

Rieger et al.

[11] Patent Number: 4,924,692

[45] Date of Patent: May 15, 1990

[54] TRANSFER PRESS HAVING GRIPPER RAILS WHICH CAN BE TRANSVERSELY SEPARATED ALONG THEIR LENGTH

[75] Inventors: Walter Rieger, Göppingen; Karl Thüdium, Wäschenbeuren, both of Fed. Rep. of Germany

[73] Assignee: L. Schuler GmbH, Goeppingen, Fed. Rep. of Germany

[21] Appl. No.: 337,758

[22] Filed: Apr. 13, 1989

[30] Foreign Application Priority Data

Apr. 14, 1988 [DE] Fed. Rep. of Germany ..... 3812365

[51] Int. Cl.[5] ..... B21J 13/08; B21D 43/10

[52] U.S. Cl. ..... 72/405; 198/621

[58] Field of Search ..... 72/405, 422; 198/621, 198/774; 414/750, 751

[56] References Cited

U.S. PATENT DOCUMENTS 4,259,052 3/1981 Imanishi ..... 72/405
4,557,133 12/1985 Mikusch ..... 72/405
4,823,587 4/1989 Wolfgang ..... 72/405

FOREIGN PATENT DOCUMENTS 3501946 7/1986 Fed. Rep. of Germany .
3511965 10/1986 Fed. Rep. of Germany ..... 72/405
3520343 12/1986 Fed. Rep. of Germany .

*Primary Examiner*—Daniel C. Crane
*Attorney, Agent, or Firm*—Barnes & Thornburg

[57] ABSTRACT

In a transfer press, the gripper rails consist of gripper rail parts located at the press and exchangeable gripper rail parts. In operation, the gripper rail parts must be rigidly connected with one another. For this purpose, a coupling element utilizing a rotary tightening device is inserted in one gripper rail part and has a tension rod which can be braced with T-shaped head behind a coupling surface of a gripper rail part located at the side of the press. Flange facings are machined into front faces of the gripper rail parts. These flange facings have flat surfaces which extend parallel to the direction of the lifting and lowering movement of gripper rail parts and the direction of the opening and closing positioning movement of a sliding table carrying exchangeable gripper rail part. The gripper rail parts are separated along the flat end surfaces of the flange facings and do not require longitudinal displacement to provide a separation gap.

16 Claims, 3 Drawing Sheets

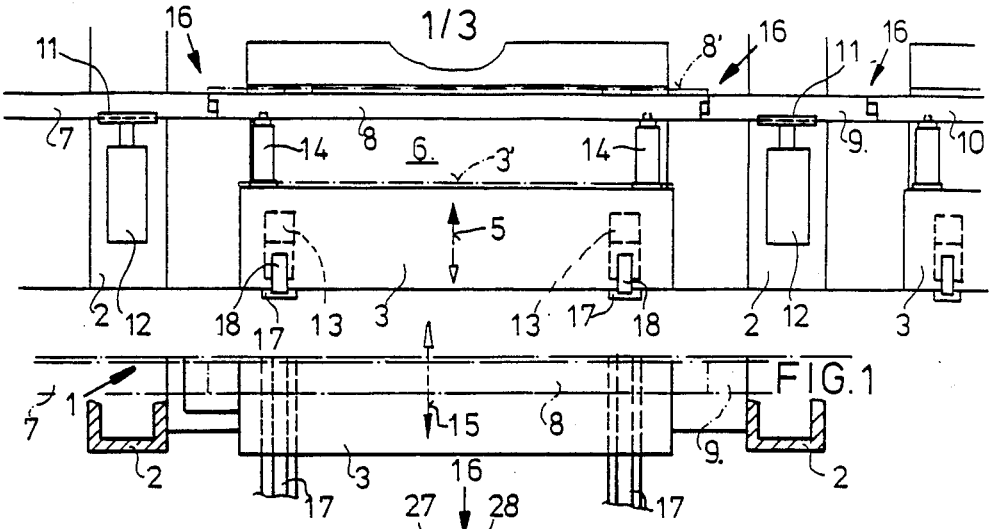
FIG. 1
FIG. 2
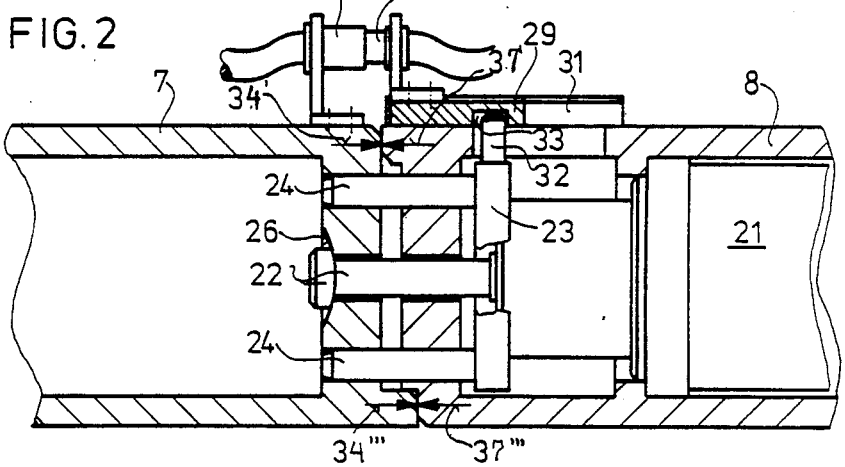
FIG. 3
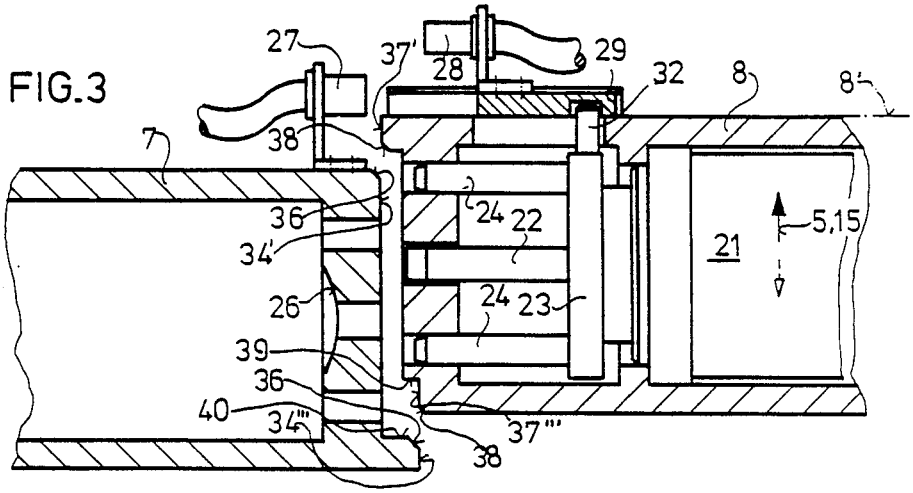

TRANSFER PRESS HAVING GRIPPER RAILS WHICH CAN BE TRANSVERSELY SEPARATED ALONG THEIR LENGTH

BACKGROUND AND SUMMARY OF THE INVENTION

The invention relates to a transfer press having gripper rail parts that can be moved in a lifting and lowering direction and comprises first gripper rail parts located in the press and exchangeable gripper rail parts located on sliding tables that can be moved into and out of the press for engagement between the first gripper rail parts. A coupling mechanism is provided for joining these gripper rail parts by pressing flange facings located in an end of one of these gripper rail parts against flange facings in the end of another adjacent gripper rail part to be coupled to the first gripper rail part.

The exchange of gripping tools and of the exchangeable adjacent gripper rails carrying these gripping tools, takes place during tool changes by means of sliding tables which can be moved into the press and out of it. The exchangeable gripper rail parts can be disconnected from the first gripper rail parts remaining in the press and can be connected to them.

In DE 35 01 946 C2, a connecting arrangement was described comprising connecting devices which form-fittingly cooperate with one another in the connected position. The front faces of the gripper rail parts have surfaces which, in the connected position are pressed against one another by means of a rotary tightening device. The surfaces are complimentary interfilting cone-shaped areas. The rotary tightening device is inserted in an end part of a gripper rail part and has a tension rod which is rotatable and can be moved in an axial direction. The tension rod can be moved out of the end part of one of the gripper rail parts and into the end part of another gripper rail part that is to be connected, and after being turned and pulled back, by the application of force, a T-shaped end of the tension rod is fixed behind a clamping surface to hold the two gripper rail sections together.

The moving of the exchangeable gripper rail part out of the press and the moving of the exchangeable gripper rail part into the press requires a separating gap between the front faces of the gripper rail parts that are to be connected with one another. The separating gap is to be produced by means of the movement of the tension rod during the disconnecting operation, by a pushing-apart of the gripper rail parts, and, during the connecting, the separating gap is closed by means of the pulling-together of the gripper rail parts.

The arrangement according to DE 35 20 343 A1 is also based on the requirement of a separating gap. This separating gap is bridged by wedges which are moved into the clearance between the ends of the gripper rail parts, during the connecting process by means of a tension rod of a rotary tightening device before the tension rod is fixed behind a clamping surface by turning and pulling-back.

It is the object of the invention to permit a connecting and disconnecting of gripper rail parts which does not require any separating gap. In a transfer press having gripper rail parts that can be moved in a lifting and lowering direction and which comprises first gripper rail parts located in the press and exchangeable gripper rail parts, located on sliding tables that can be moved into and out of the press for engagement between the first gripper rail parts, a coupling mechanism is provided for joining these gripper rail parts by pressing flange facings located in an end of one of these gripper rail parts against flange facings in the end of another adjacent gripper rail part, to be coupled to the first gripper rail part. Here a non-separating gap is obtain by having flange facings that have a flat plane surface parallel to the lifting and lowering movement of the gripper rail parts and wherein each end face of the gripper rail part has a plurality of flange facings that are complimentary to an adjoining set on an end face of an adjacent gripper rail part, and wherein the flange facings on the engageable gripper rail sections are moved at right angles to their flat surfaces at a separation plane between the two gripper rails during any of lifting and lowering of the rails, or sliding movement of the sliding table into and out of the press.

It is also advantageous to have the flange facings extend over a width of the gripper rail parts and with a width thereof being less than the movement distance of the sliding table.

Additionally, the flange facings in each set can project different distances from the end faces of the gripper rail parts, in a stair step manner, with the flange facing closest to the press extending out the furtherest, or alternatively all the flange facings can project out at an equal distance without a stair step arrangement.

A center flange facing should have an interruption along its length to allow for passage of a T-shaped hammer head, which extends from one gripper rail part into another and then is rotated to cause the legs of the "T" to engage on a cam surface to force the two gripper rails together. Additionally, the actuator for the T-head can position centering pins between two coupled gripper rail parts as well as move a power coupling device so as to provide a power transfer path between gripper rail parts.

The distance between flange facings should be greater than the width of a flange facing. The ends of the flange facings can be provided with sloped surfaces adjacent their flat plane surfaces.

The development of the front faces at the end parts of the gripper rail parts according to the invention, reduces the exchange time of the gripper rail parts considerably. The machining of the front faces is simplified and therefore less expensive. The number of movements and components for the connecting and disconnecting is reduced. No separating movement and therefore no moving of the gripper rail parts along their length is required. The control of the locking devices at the press and at the sliding table may be simplified. The flange facings, with respect to their flat surfaces, may be enlarged significantly so that surface pressure may be reduced. In individual cases, the lifting and lowering motion for the movement of the flange facings in the connecting and disconnecting plane may be less than the height and possibly the width of the gripper rail parts. The connecting and disconnecting motion of the exchangeable gripper rail part may take place by means of the movement of the sliding table.

Other objects, advantages and novel features of the present invention will become apparent from the following detailed description of the invention when considered in conjunction with the accompanying drawings.

BRIEF DESCRIPTION OF THE DRAWINGS

FIG. 1 is a front view and a partial top view of the work area of a transfer press with a sliding table and gripper rails;

FIG. 2 is a view of end areas of gripper rail parts of a first embodiment in the connected state;

FIG. 3 is a view of end areas of the gripper rail parts shown in FIG. 2 in the disconnected state;

DETAILED DESCRIPTION OF THE DRAWINGS

Figure 4:
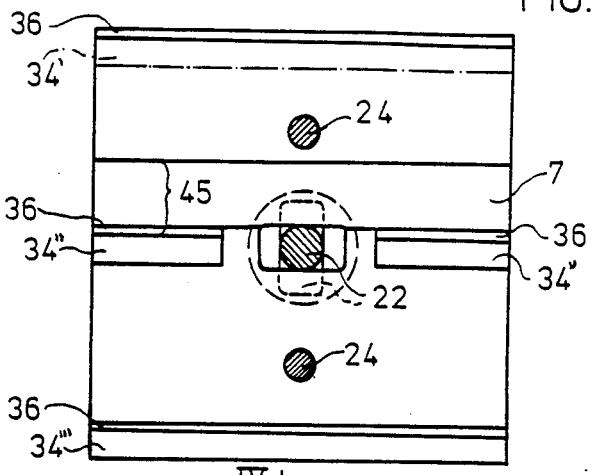
FIG. 4 is a view of a front face at the end area of a second embodiment of a gripper rail part corresponding to the viewing direction indicated by the arrows IV—IV in FIG. 5.

FIG. 1 shows a sliding table 3 that has been moved into the work area of the transfer press 1 between press stands 2 and which has been slightly lowered. The lifting and lowering movement of the sliding table 3 is shown by direction 5 and is effectuated through working cylinders 13 in the sliding table, or in the press bed. The sliding table 3, can be moved in an opening and closing direction (double arrow 15) by means of rollers 18 guided on tracks 17. When the transfer press 1 is set up for a new workpiece, a tool 6, a tool set, or parts of the gripper rails, these items can be exchanged by means of the sliding table 3.

Two gripper rails are provided and extend over the length of the changing movement of the workpieces. The separable gripper rails consist of first gripper rail parts 7, 9 (FIG. 1), or 41, 43 (FIG. 7), on the sides of the press and which remain in position at the transfer press 1, and exchangeable gripper rail parts 8, 10 (FIG. 1) or 42 (FIG. 7) which can be moved into and out of the transfer press 1 by means of the sliding table 3. The drive of the gripper rails for changing of workpieces takes place in a lifting and lowering motion and in both an opening and closing motion from the direction of closing boxes 12 by means of guiding devices 11. For the changing of workpieces, this drive takes place at the front face of the transfer press.

Figure 7:
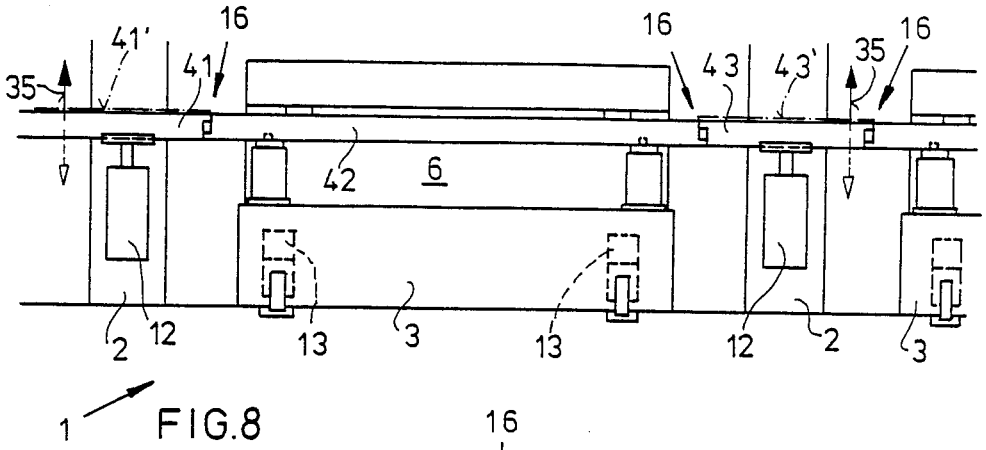
FIG. 7 is a front view of a second embodiment regarding the connecting and disconnecting operation in a working area of a transfer press with a sliding table and gripper rails.

The lifting and lowering motion of the sliding table 3 in direction 5 may be utilized for the lifting of the exchangeable gripper rail parts 8, 10 and 42. In this case, the exchangeable gripper rail parts separate from the other gripper rail parts 7, 9 at the separating points indicated by reference number 16. Reference number 14 denotes rests on the sliding table 3 for the exchangeable gripper rail parts 8, 10 (FIG. 1) or 42 (FIG. 7). These may consist of lifting cylinders and be used for the connecting and disconnecting of the exchangeable gripper rail parts 8, 10 and 42 from the other gripper rail parts 7, 9, 41 and 43 by means of a lifting and lowering in direction 5, instead of moving the sliding table 3 in an open or closing direction 15.

Fig. 2 shows a conventional available coupling element 21 called a rotary tightening device which is inserted into the end piece of the exchangeable gripper part 8. The rotary tightening device 21 produces the required movements for a tension rod 22. For coupling (FIG. 1), this tension rod 22 is pushed forwardly out of the exchangeable gripper rail part 8, beyond the separating point 16, into the gripper rail part 7. This tension rod is then rotatingly turned and partially pulled back into the exchangeable gripper rail part 8 so that edges of the T-shaped hammer-head rod end rest against a clamping surface 26 of the gripper rail part 7. By means of the expenditure of force in the rotary tightening device 21, the gripper rail parts 7, 8, 9, 10 (FIG. 1) and gripper rail parts 41, 42, 43, etc. (FIG. 7) are pressed together and braced with respect to one another. A bridge part 23 is moved along with the tension rod 22 and carries centering pin(s) 24 for aligning the gripper rail parts 7, 8, 9, 10, 41, 42, 43 with respect to one another before the mutual bracing. The bridge part also is provided with a guide pin 32 that is moved along with the bridge part 23 and which engages in a groove 33 of a carriage 29. The carriage 29, which is movable in the direction of the longitudinal dimension of gripper rail part 8, carries one half 28 of an energy coupling device. The other half 27 of the coupling device is fixedly arranged at gripper rail part 7. These guide pins and energy coupling components are not shown in the other figures.

FIG. 3 shows the tension rod 22, which is pulled back into gripper rail part 8, along with the centering pins 24 and the carriage 29 which are also simultaneously moved back by the bridge part 23. In FIGS. 2 and 3, reference number 34′ and 34‴ denote flange facings at gripper rail part 7, which are located at the side of press, and reference numbers 37′ and 37‴ denote flange facings at the exchangeable gripper rail part 8. The flange facings 34′, 34‴, 37′, and 37‴ are each located in the edge areas of the front faces of their gripper rail parts and extend over their width. The flange facings shown in these figures and in the additional figures are plane flat surfaces. The flat surface of each flange facing 34′, 34‴, 37′, 37‴ extends parallel to and in the direction 5 of the lifting and lowering movement of the gripper rail parts, as well as in the opening and closing direction 15 of the positioning movement of the sliding table 3. The flange facing 37′ at the exchangeable rail part 8, with respect to flange facing 37′, which is this embodiment is set back with respect to the main surface part of the front face, projects farther out of the front face. As a result, during disconnecting of the gripper rail sections, an offset distance is created between the gripper rail parts 7, 8, 9, 10, etc. by means of the lifting of gripper rail part 8 (direction 5) or during the moving-out of the sliding table 3 (direction 15). The width of the flange facings 34′, 34‴, 37′, 37‴ may be sized to the length of the lifting and lowering movement of the gripper rail sections. Thus the recess width, as a measurement, measured in direction 5, may correspond to approximately the length of this lifting movement. The required minimum width may be calculated from the permissible surface pressure. The slight lifting and lowering motion of the sliding table 3, from a detent at the press bed, is sufficient for the disconnecting or connecting if a mathematical minimum width can be maintained. Numeral 15 relates to the positioning movement of the sliding table 3 which extends at 90 angular degrees to the lifting and lowering direction 5 of the sliding table 3, or of the longitudinal axis of the lifting cylinders 14. If the positioning movement of the sliding table 3 is utilized for connecting and disconnecting, the flange facings 34', 34''', 34' and 37''' may also be entered into the front faces in a vertical arrangement. The projecting flange facings 34''' and 37' are provided with stop slopes 36, 38 for the first contact between the gripper rail parts 7, 8, 9, 10, 41, 42, 43, when they approach.

The projecting flange facing 34''' at the gripper rail parts 7, 9, which are located at the sides of the press, form a stop face 40, against which the stop face 39 of the exchangeable gripper rail part 8, 10 can be placed during the connecting function. At the same time, these stop faces 39, 40 act against an unwanted lowering of the exchangeable gripper rail parts 8, 10. Reference number 8' (FIG. 1) denotes the lifted-out position of the exchangeable gripper rail parts 8, 10 caused by the lifting of the sliding table 3.

Figure 5:
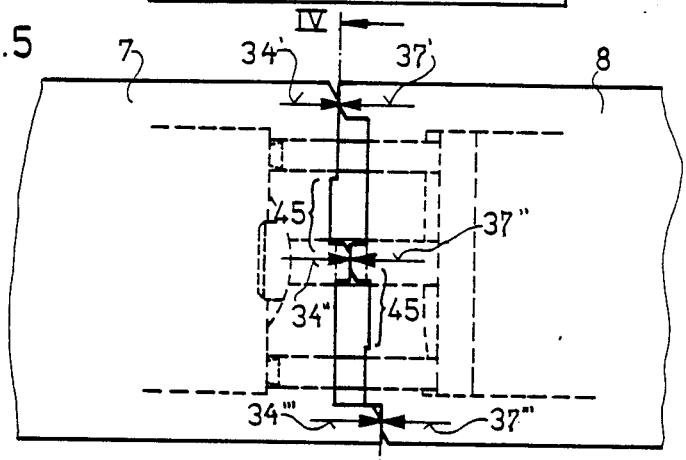
FIG. 5 is a view of end areas of gripper rail parts of the second embodiment in the connected state.
Figure 6:
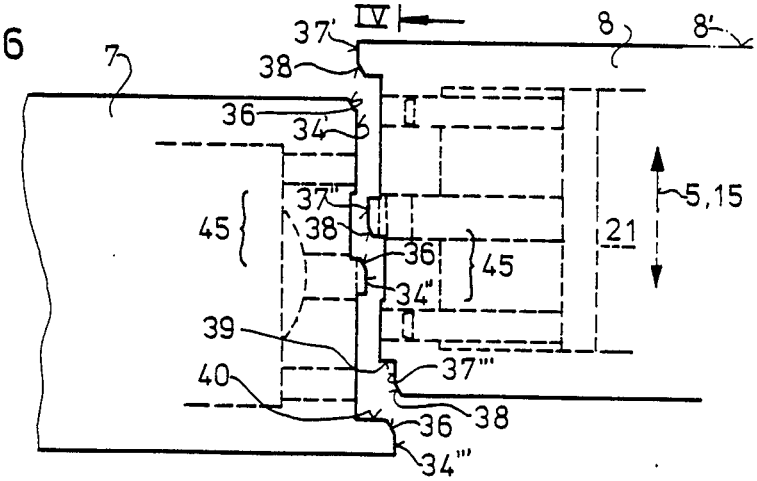
FIG. 6 is a view of end areas of the gripper rails parts shown in FIG. 5 in the disconnected state.

FIGS. 4–6 show a modification arrangement wherein three flange facings 34', 34'', 34''' are provided to extend over the width of the front face of gripper rail part 7. When a rotation of the gripper rail parts 7, 8, 9, 10, 41, 42, 43 by 90 angular degrees around their longitudinal axis occurs, then the flange facings extend along the heights of gripper rail part 7 or all gripper rail parts 7, 8, 9, 10, 41, 42, 43. Flange facing 34'', which extends essentially in the center with respect to flange facings 34', 34''', located in the outer edge areas of the front face, is interrupted along its length, to provide for the moving range of the tension rod 22. This arrangement of the threes flange facings 34', 34'', 34''' and 37', 37'', 37''', in connected and disengaged position is also shown in FIGS. 5 and 6.

FIGS. 5 and 6 show that flange facings 34', 34'', 34''', project out of the front faces of the gripper rail parts 7 to a different extent. The exchangeable gripper rail part 8, with its displaced flange facings 37', 37'', 37''' must be guided past flange facings 34', 34'', and 34''' of the gripper rail part 7 which is located at the side of the press and remains there in a lateral motion, during connection and disconnection of the gripper rail parts. Flange facing 37' at the exchangeable gripper rail part 8, which is located on top and in front in direction 5, 15, 35 of the connecting and disconnecting movement, projects further out of the front face than the second adjacent flange facing 37''. The second flange facing 37'', in turn, projects further out of the front face than the third, here the lowest, flange facing 37'''. The flange facings 37', 37'', 37''', at the exchangeable gripper rail part 8 therefore project out of the front face in a reversed manner from the complementary flange facings 34', 34'', 34''' on the rail part on the press side.

Since the lifting and lowering motion in direction 5 must only be slightly larger than the width of the flange facings in order to be able to move the exchangeable gripper rail parts 8, 10, 42 out of the transfer press 1, the clearance 45 between the flange facings must be designed to be slightly larger than the width of the flange facings. The chambers 36, 38 at the flange facings 34, 37, with respect to their length and inclined position should be developed corresponding to the precision of the lifting and lowering movement, or the positioning movement. The connecting and disconnecting motion of the gripper rail parts 7, 8, 9, 10, 41, 42, 43, for all embodiments, takes place in a plane which is shown in detail in FIG. 9 and there has the reference number 46.

In FIGS. 1 to 6, it was assumed that the connecting and disconnecting movement takes place by means of the lifting and lowering of the sliding table 3, or by means of the movement in direction 5 of the lifting cylinders 14 mounted on table 3, or by means of the positioning movement of the sliding table in direction 15.

FIG. 7 shows a transfer press 1 having press stands 2 and a movable sliding table 3. The gripper rails, which exist in pairs, are also subdivided into gripper rail parts 41 and 43 located on the press side and exchangeable gripper rail parts 42. The connecting and the disconnecting of these gripper rail parts takes place in the area of separating point 16 by means of the closing box 12, or by means of the lifting and lowering movement in direction 35 which can be carried out by the closing boxes 12. This lifting and lowering movement is larger or at least as large as the additive movement of the required connecting and disconnecting movement and the lifting and lowering movement of the sliding table 3 during its moving-out. The required lift of the gripper rail parts 41, 43 is shown by means of dash-dotted lines 41', 43'.

Figure 8:
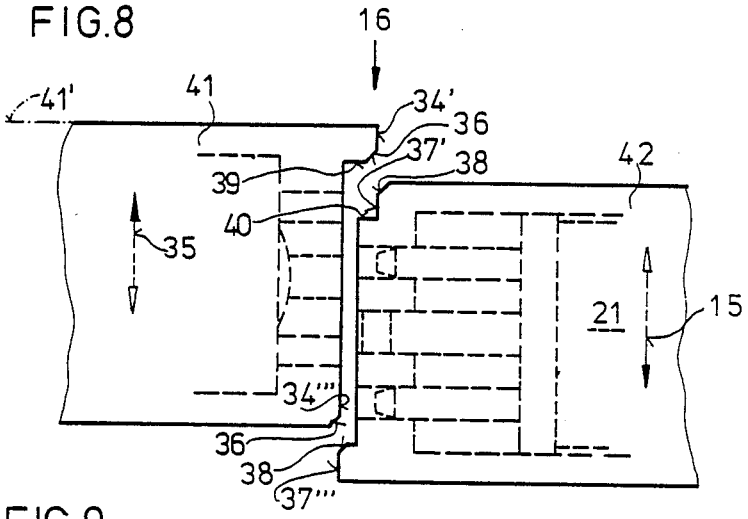
FIG. 8 is a view of end areas of gripper rail parts of a third embodiment in the disconnected state.

FIG. 8 shows the construction of the front faces of gripper rail parts 41, 42 for the application described in FIG. 7. Gripper rail part 41 or 43, which, by means of the closing box 12, can be lifted and lowered in direction 35, have flange facings 34', 34'''. Flange facing 34' at gripper rail part 41 or 43, which as viewed in direction 35, is on top and projects further out of the front face than the lower flange facing 34'''. In the case of an arrangement in threes, according to FIG. 4, flange facing 34' or 34'' projects further out than adjacent flange facing 34'' or 34'''.

Flange facings 37', 37'', 37''' at the exchangeable gripper rail part 42 are arranged to be offset in a reversed manner. Arrow 15 indicates the positioning movement of the sliding table 3 which is turned by 90 angular degrees with respect to direction 35.

When, in a further development of FIG. 8, the flange facings are arranged in a manner, in which they extend along the height of the gripper rail parts 41, 42 (FIG. 8 would then be a top view), the flange facings 34' or 34'' at the press-side gripper rail part 41, 43 which, with respect to the positioning movement of the sliding table 3 in direction 15, are located in the rear and project further out of the front face than the front flange facings 34', 34'' or 34''', located in front. The complementary flange facings 37', 37'', 37''' must be constructed correspondingly. For the embodiment according to FIG. 8, as well as for another embodiment, which will be described below, the exchangeable gripper rail parts 42 located in the rear must be constructed to be shorter in order to be able to guide them through the front press-side gripper rail parts 41, 43 with the positioning movement of the sliding table 3 in direction 15.

Figure 9:
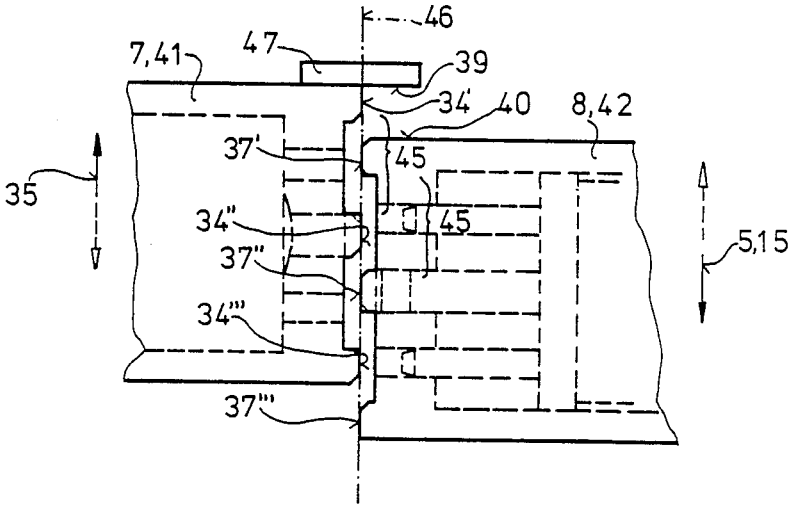
FIG. 9 is a view of end areas of gripper rail parts of another embodiment in the disconnected state.

FIG. 9 shows a construction of the flange facings which project out of the front faces of the gripper rail parts 7, 9, 41, 43 and 8, 10, 42 equally far and are located in plane 46. This plane 46 may also generally be considered to be the positioning plane of all shown embodiments. Stop 47 is used for limiting the movement of that gripper rail part 7, 9, 41, 43 or 8, 10, 42, which is moved into the connected position in direction 5, 15, 35. Reference number 15 again indicates a direction of the positioning movement of the sliding table 3 which is turned by 90 angular degrees. The gripper rail parts 8, 42 located on the sliding table 3, can therefore be moved out of the transfer press 1 and into it without any lifting and lowering motion of the press-side gripper rail parts 7, 9, 41, 43. Correspondingly, flange facings must be provided with chambers 36, 38 on both sides in the direction of the positioning movement 15, as shown also by dash-dotted lines.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. A transfer press having connectable gripper rail parts that can be moved in a vertical lifting and lowering direction wherein the gripper rail parts comprise:

first gripper rail parts, located in the press and exchangeable gripper rail parts that can be moved out of engagement with said first gripper rail parts by sliding tables means;

coupling means for connecting the first and exchangeable gripper rail parts with one another by pressing flange facings located at front faces of the first and exchangeable gripper rails parts against one another when the first and exchangeable gripper rail parts are aligned for coupling;

the coupling means being inserted into end areas of the first and exchangeable gripper rail parts for pressing the flange facings against one another;

wherein the flange facings have flat plane surfaces, which extend parallel to the vertical lifting and lowering movement of the gripper rail parts;

control means for vertically lifting and lowering each of the first and exchangeable gripper rail parts with respect to one another and for vertically lifting and lowering the sliding table;

positioning means for controlling horizontal sliding movement of the sliding table into and out of the transfer press while the gripper rail parts are aligned for coupling without separating the gripper rail parts;

the flange facings comprising sets of complementary flange facings, which during the moving of the exchangeable gripper rail parts to coupling alignment with the first gripper rail parts, the flange faces are moved at right angles to their flat surfaces and in a direction of the vertical lifting and lowering movement or in a direction of the horizontal sliding movement of the sliding table into and out of the transfer press.

2. A transfer press according to claim 1, wherein the flange facings of the sets of flange facing extend at least over a partial width of the front face of the gripper rail parts and have a width, transversely to a longitudinal dimension of the gripper rail parts of a dimension, measured in the direction of the lifting and lowering movement, which is less than a distance of this movement.

3. A transfer press according to claim 1 wherein each flange facing of one set of flange facings project to a different extent, out of the front face of the associated gripper rail parts;

a flange facing of two adjacent flange facings which is on top viewed in direction of the lifting and lowering movement of the exchangeable gripper rail parts, projects further out of the front face of the exchangeable gripper rail part than flange facing located underneath as viewed in the same direction; and wherein the flange facings of the complimentary set of two adjacent flange facings of the first gripper rail part viewed in direction of the lifting and lowering movement, is on the bottom projecting further out of the front face of the first gripper rail part than the flange facing located above it.

4. A transfer press according to claim 1, wherein each flange facing of one set of flange facings project to a different extent out of the front face of the associated gripper rail part;

a flange facing of, two adjacent flange facings which is on top, viewed in direction of the lifting and lowering movement, of the first gripper rail part projects further out of the front face of the first gripper rail part than the flange facing located underneath, and wherein the flange facings of the complimentary two adjacent flange facings of the exchangeable gripper rail parts which, viewed in the direction of the lifting and lowering movement, is on the bottom projecting further out of the front face of the exchangeable gripper rail parts than the flange facing located above it.

5. A transfer press according to claim 1, wherein the flange facings of one set of flange facings are separated from one another by a distance that is larger than a width of any of the flange facings, of the set of flange facings.

6. A transfer press according to claim 1 wherein the flange facings of a set of flange facings project uniformly out of the front faces of both gripper rail parts to be connected with one another.

7. A transfer press according to claim 1 wherein each flange facing of the set of flange facings are provided with stop slopes.

8. A transfer press according to claim 1 wherein the coupling means in the end area of the gripper rails parts a rotary tightening device which is located at an end part of one of the gripper rail parts and is projected out of that gripper rail part by a tension rod, beyond a separating point between adjacent gripper rail parts and into a gripper rail part to be connected, and is connected thereto by a turning and partial pulling-back of the tension rod into the end part of the one gripper rail part after the tightening device is fixed behind a clamping surface of the gripper rail part to be connected.

9. A transfer press according to claim 8 wherein a centrally located flange facing of each set of flange facings is interrupted along its length to provide for clearance of movement of the tension rod.

10. A transfer press according to claim 8, wherein a bridge part is moved along with the tension rod and holds centering pins engaging in the gripper rail parts to be connected, and also moves at least one guide pin for coupling an energy coupling device when the gripper rails are coupled.

11. A transfer press according to claim 1, wherein the flange facings of said sets of flange facings extend along at least a partial height of the front face of the gripper rail parts.

12. A transfer press according to claim 11, wherein the exchangeable gripper rail part is dimensioned such that a front side thereof, in a direction of the movement of the sliding table into the transfer press, is longer than a rear side, facing away from the transfer press.

13. A transfer press according to claim 11 wherein the flange facings of a set of flange facings project uniformly out of the front faces of both gripper rail parts to be connected with one another.

14. A transfer press according to claim 1, wherein the flange facings of one set of flanges facing, project out of the front face of the gripper rail parts to a different extent; and wherein the flange facing of two adjacent sets of facings, viewed in direction of the movement of the exchangeable gripper rail parts, project further out of the front face than a flange facing located behind it.

15. A transfer press according to claim 11, wherein the flange facings of one set of flanges facing, project out of the front face of the gripper rail parts to a different extent; and wherein the flange facing of two adjacent sets of facings, viewed in direction of the movement of the exchangeable gripper rail parts, project further out of the front face than a flange facing located behind it.

16. A transfer press according to claim 12, wherein the flange facings of one set of flanges facing, project out of the front face of the gripper rail parts to a different extent; and wherein the flange facing of two adjacent sets of facings, viewed in direction of the movement of the exchangeable gripper rail parts, project further out of the front face than a flange facing located behind it.

* * * * *